US010441857B2

(12) United States Patent
Abe

(10) Patent No.: US 10,441,857 B2
(45) Date of Patent: Oct. 15, 2019

(54) IRON GOLF CLUB HEAD

(71) Applicant: Sumitomo Rubber Industries, Ltd., Hyogo (JP)

(72) Inventor: Hiroshi Abe, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 16/033,560

(22) Filed: Jul. 12, 2018

(65) Prior Publication Data

US 2019/0015711 A1 Jan. 17, 2019

(30) Foreign Application Priority Data

Jul. 13, 2017 (JP) ..... 2017-136693

(51) Int. Cl.

| | |
|---|---|
| ***A63B 53/04*** | (2015.01) |
| ***A63B 53/02*** | (2015.01) |
| ***A63B 60/02*** | (2015.01) |
| *A63B 102/32* | (2015.01) |
| *A63B 60/54* | (2015.01) |

(52) U.S. Cl.

CPC ..... *A63B 53/047* (2013.01); *A63B 53/02* (2013.01); *A63B 60/02* (2015.10); *A63B 60/54* (2015.10); *A63B 2053/0408* (2013.01); *A63B 2053/0433* (2013.01); *A63B 2053/0445* (2013.01); *A63B 2053/0491* (2013.01); *A63B 2102/32* (2015.10)

(58) Field of Classification Search

USPC ..... 473/324–350

See application file for complete search history.

(56) References Cited

U.S. PATENT DOCUMENTS

| | | | | |
|---|---|---|---|---|
| 5,282,625 A * | 2/1994 | Schmidt | ..... | A63B 53/04 473/350 |
| 5,301,946 A * | 4/1994 | Schmidt | ..... | A63B 53/04 473/290 |
| 5,330,187 A * | 7/1994 | Schmidt | ..... | A63B 53/04 473/291 |
| 5,344,150 A * | 9/1994 | Schmidt | ..... | A63B 53/04 473/290 |

(Continued)

FOREIGN PATENT DOCUMENTS

| | | | |
|---|---|---|---|
| JP | 2001231896 A * | 8/2001 | |
| JP | 2016-221181 A | 12/2016 | |
| JP | 2016221181 A * | 12/2016 | ..... A63B 53/047 |

*Primary Examiner* — Alvin A Hunter

(74) *Attorney, Agent, or Firm* — Studebaker & Brackett PC

(57) ABSTRACT

An iron golf club head comprises a clubface with score lines, a top, a sole, a hosel with a shaft inserting hole. In a standard state of the head set on a horizontal plane such that the score lines become horizontal and the axis of the club shaft inserting hole lies within a vertical plane, the head satisfies the following condition (1) in the cross section of the head taken orthogonally to the vertical plane at any position in the toe-heel direction between the heel-side most end of the score lines and the position at which the clubface height becomes maximum: (1) the horizontal distance A from the lower edge of the clubface to a backmost end of the head on the sole-side is not more than the horizontal distance B from the lower edge of the club face to a backmost end of the head on the top-side. The depth of the center of gravity is 5.5 mm or more.

12 Claims, 12 Drawing Sheets

(56) References Cited

U.S. PATENT DOCUMENTS

| | | | | | |
|---|---|---|---|---|---|
| 5,472,203 | A * | 12/1995 | Schmidt | A63B 53/04 | 473/350 |
| 5,536,011 | A * | 7/1996 | Gutowski | A63B 53/04 | 473/350 |
| 5,823,887 | A * | 10/1998 | Mikame | A63B 53/04 | 473/290 |
| 5,833,551 | A * | 11/1998 | Vincent | A63B 53/04 | 473/350 |
| 6,196,934 | B1 * | 3/2001 | Sherwood | A63B 53/04 | 473/290 |
| 6,530,846 | B1 * | 3/2003 | Mase | A63B 53/00 | 473/290 |
| 7,390,270 | B2 * | 6/2008 | Roberts | A63B 53/047 | 473/332 |
| 7,513,835 | B2 * | 4/2009 | Belmont | A63B 53/0466 | 473/328 |
| 2016/0354650 | A1 | 12/2016 | Norimura | | |

* cited by examiner

IRON GOLF CLUB HEAD

TECHNICAL FIELD

The present invention relates to an iron golf club head

BACKGROUND ART

The following patent document 1 discloses an iron golf club having a loft angle of 41 degrees or less, a club head thickness of 23 mm or less, and a club face height of 53 mm or more. such iron golf club has advantages such that a player easily address the ball because, when the player has addressed the ball and grounded the golf club head, the trailing edge of the sole of the club head is out of the player's sight. However, if attaching importance to easy addressing, an iron golf club head is reduced in the width of the sole, then the center of gravity G of the club head tends to shift toward the club face, and thereby it becomes difficult to shot the ball high.

Patent document 1: Japanese Patent Application Publication No.2016-221181

SUMMARY OF THE INVENTION

The present invention was made in view of the circumstances described above, and a primary object thereof is to provide an iron golf club head having a shape which allows a player to easily address the ball as well as to shot the ball high.

According to the present invention, an iron golf club head comprises:

a club face provided with score lines (grooves), a top extending backward of the club head from an upper edge of the club face.

a sole extending backward of the club head from a lower edge of the club face, and a hosel disposed in a heel side of the club head and provided with a shaft inserting hole, wherein the depth GL of the center of gravity G of the club head is 5.5 mm or more, wherein in a standard state of the club head in which the club head is set on a horizontal plane such that the score lines become horizontal and the central axis of the club shaft inserting hole lies within a vertical plane, the club head satisfies the following condition (1) in the cross section of the club head taken orthogonally to the above-said vertical plane at any position within a range in the toe-heel direction of the club head which range is defined between the position of the heel-side most end of the score lines and the position at which the height of the club face becomes maximum:

(1) the horizontal distance A from the lower edge of the club face to the position of a backmost end of the club head on the sole-side is not more than the horizontal distance B from the lower edge of the club face to the position of a backmost end of the club head on the top-side.

The loft angle of the club face may be 34 degrees or less.

The club face height may be in a range from 32.0 to 60.0 mm.

The top thickness which is the thickness of the top measured in a perpendicular direction to the club face may be in a range from 3.0 to 10.0 mm.

The club head thickness which is the thickness from the club face to the rear face of the club head measured in a perpendicular direction to the club face may be in the range from 15.0 to 28.0 mm.

The iron golf club head may be composed of: a head main body having the club face, a weight member having a specific gravity larger than that of the club head main body, and a fixing member fixed to the head main body and covering the weight member.

It may be possible that the weight member is made of a material having lower weldability with a material of the club head main body, the specific gravity of the fixing member is more than the specific gravity of the club head main body, and less than the specific gravity of the weight member, the fixing member is made of a material having higher weldability with the material of the club head main body, and the fixing member is fixed to the head main body by welding.

At least part of the club face may be formed by a titanium alloy.

DESCRIPTION OF THE PREFERRED EMBODIMENTS

Embodiments of present invention will now be described in detail in conjunction with accompanying drawings.

FIGS. 1 to 4 show the front view, rear view, bottom view and top view of an iron golf club head 1 as an embodiment of the present invention under its standard state.

Figure 5:
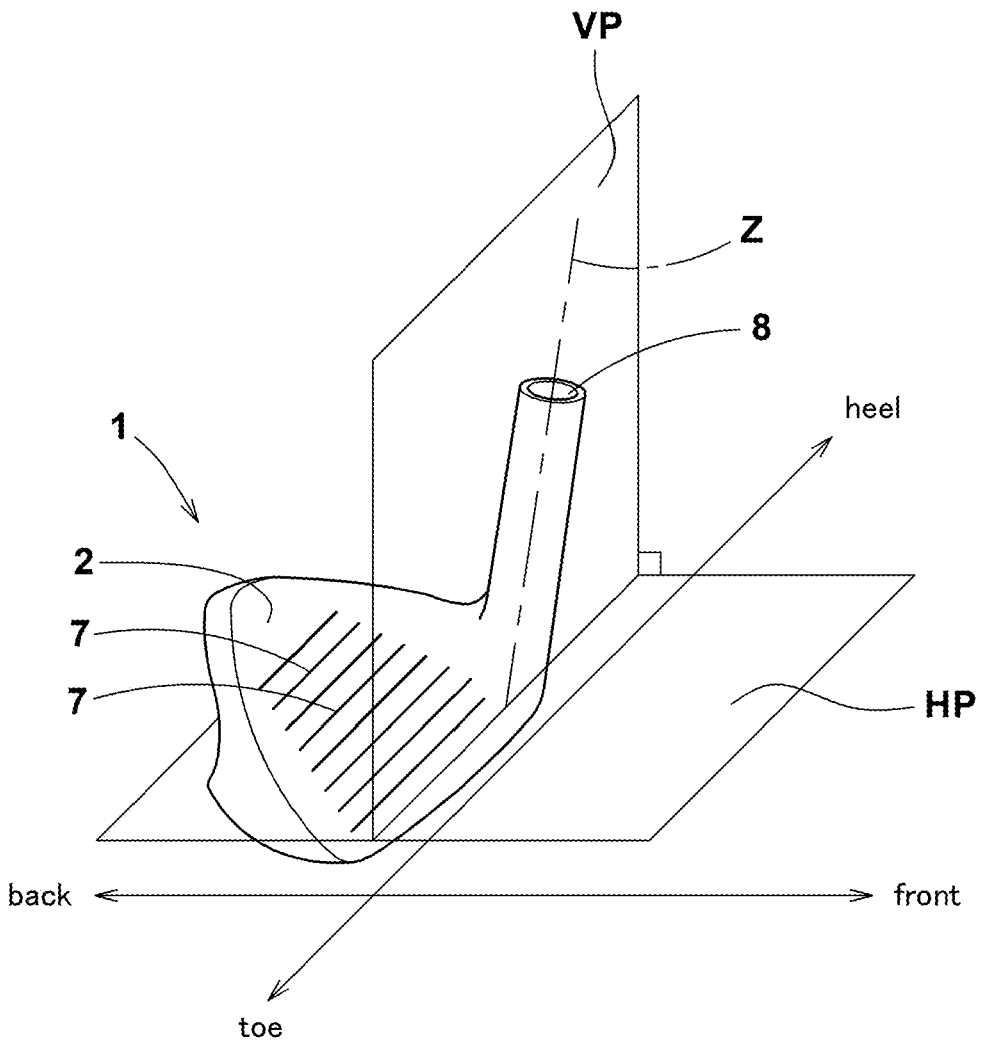
FIG. 5 is a schematic perspective view of an iron golf club head for explaining the standard state of the golf club head.

The standard state of an iron golf club head is such a state that the club head 1 is set on a horizontal plane HP so that score lines (grooves) 7 formed in the club face 2 become parallel with the horizontal plane HP, and the central axis z of the shaft inserting hole 8 of the iron golf club head 1 lies within a vertical plane VP perpendicular to the horizontal plane HP as shown in FIG. 5.

In the standard state, the score lines (grooves) 7 are parallel with the vertical plane VP as well as the horizontal plane HP.

In this application including the description and claims, dimensions, positions, directions and the like relating to the club head refer to those under the standard state of the club head unless otherwise noted.

"Toe-heel direction" is a direction parallel with the horizontal plane HP and the vertical plane VP, namely, parallel with the score lines 7.

"Up-down direction" is a direction perpendicular to the horizontal plane HP.

"Front-back direction" is a direction parallel with the horizontal plane HP and perpendicular to the vertical plane VP.

As shown in FIGS. 1 to 4, the iron golf club head 1 in this embodiment has a shape which is typical of the iron golf club heads and comprises a club face 2, a top 3, a sole 4, a toe 5 and a hosel 6.

The club face 2 is a substantially flat surface for hitting a golf ball. The club face 2 has an upper edge 2*a* and a lower edge 2*b*. The club face 2 is provided with score lines (grooves) 7 extending in the toe-heel direction of the club head in order to increase the friction with the ball.

The top 3 is an upper surface of the club head extending backward of the club head from the upper edge 2*a* of the club face 2.

The sole 4 is a bottom surface of the club head extending backward of the club head from the lower edge 2*b* of the club face 2.

The toe 5 is a part being most distant from the hosel 6 and smoothly connecting between the top 3 and the sole 4.

The hosel 6 is a part provided with a shaft inserting hole 8 into which a clubshaft is inserted, and formed in a tubular shape, for example. The center line Z of the club shaft inserting hole 8 substantially coincides with the central axis of the clubshaft inserted therein.

Figure 6A:
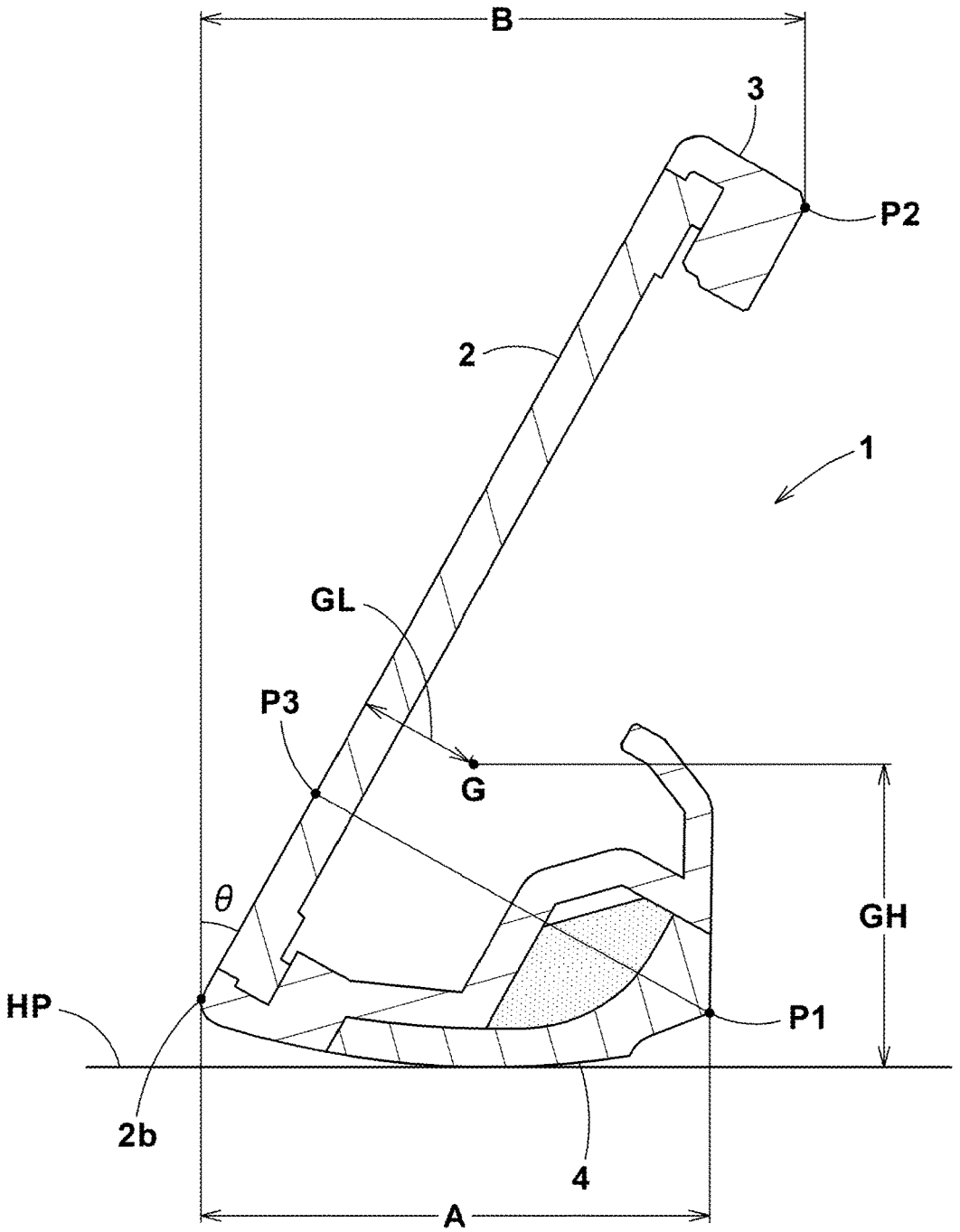
FIG. 6A and FIG. 6B are the same cross sectional view differently annotated, taken along line X-X in FIG. 4.

As shown in FIG. 6A, the iron golf club head 1 has a backmost end P1 on the sole 4 side, a backmost end P2 on the top 3 side, and a leading edge formed by the lower edge 2*b* of the club face 2.

In the iron golf club head 1 according to the present invention, the horizontal distance A (mm) from the lower edge 2*b* of the club face 2 to the position of the backmost end P1 of the club head on the sole 4 side is set to be not more than the horizontal distance B (mm) from the lower edge 2*b* of the club face 2 to the position of the backmost end P2 of the club head on the top 3 side.

Figure 6B:
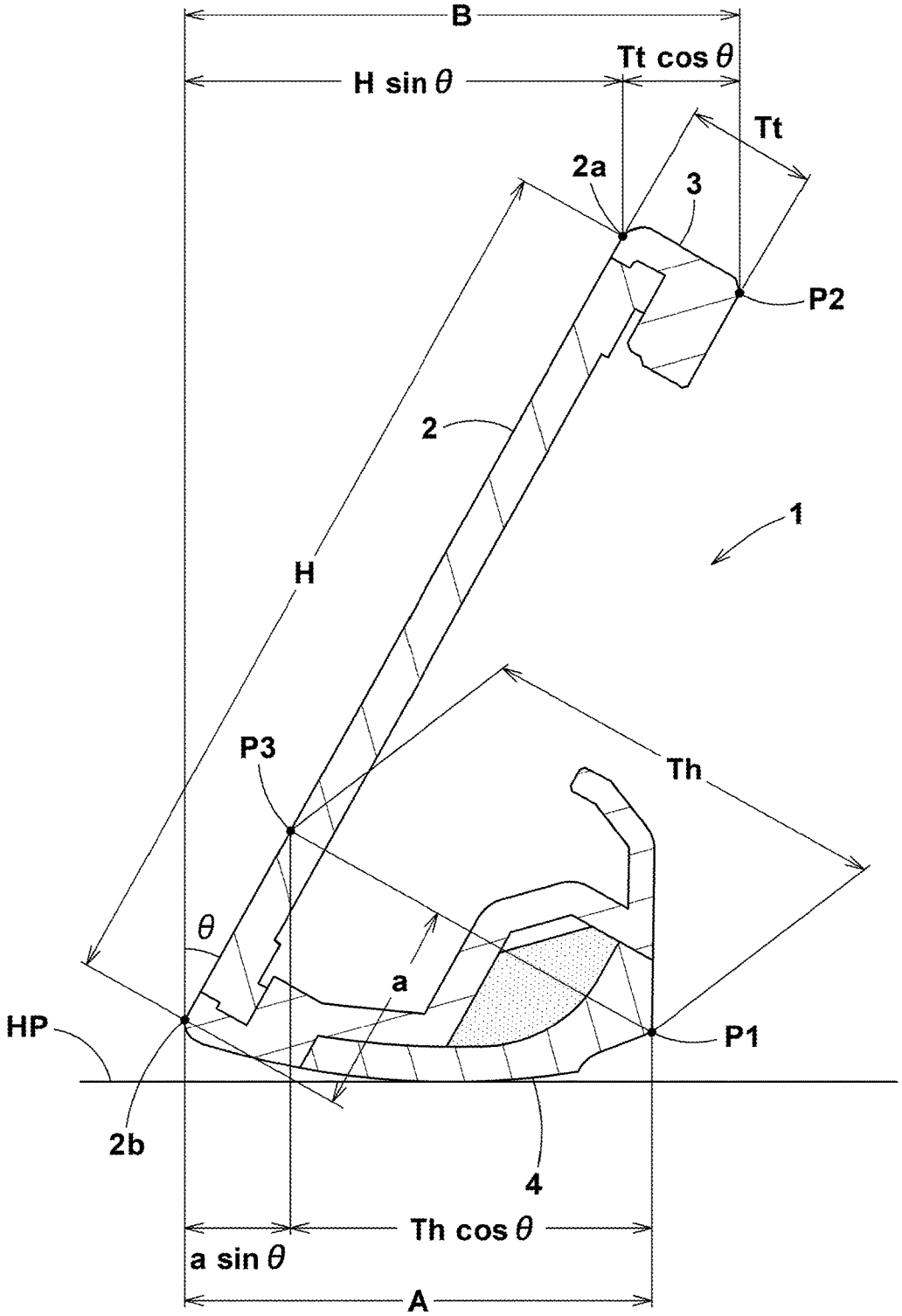

The horizontal distances A and B can be obtained by the following expressions:

$$\text{horizontal distance } A = Th \times \cos\theta + a \times \sin\theta$$

$$\text{horizontal distance } B = H \times \sin\theta + Tt \times \cos\theta$$

wherein, as shown FIG. 6B,

"θ" is the loft angle of the club head 1,

"Th" is the maximum thickness of the club head measured in the direction perpendicular to the club face 2, "a" is the length measured in parallel with the club face 2 from a position P3 on the club face 2 side at which the club head thickness becomes a maximum to the lower edge 2*b* of the club face 2, "H" is the club face height measured in the direction perpendicular to the score lines 7 along the club face 2, and "Tt" is the thickness of the top 3 measured in the direction perpendicular to the club face 2.

Figure 4:
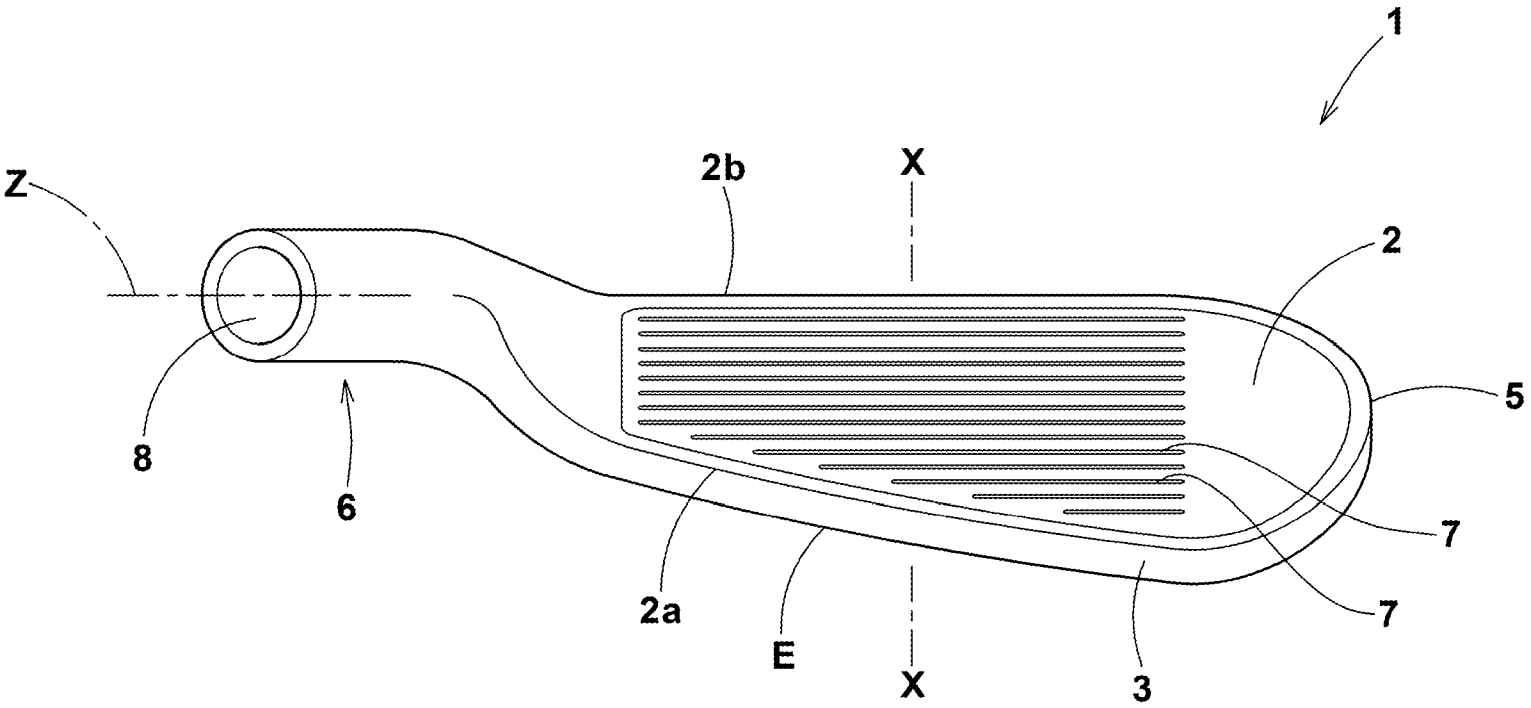
FIG. 4 is a top view of the iron golf club head shown in FIG. 1.

Using a golf club including the iron golf club head 1 constructed as above, when the player has addressed the ball and normally grounded the club head 1 (thus, the state of the club head 1 is substantially the same as the above-described standard state), the backmost end P1 on the sole 4 side, of the club head becomes out of the player's sight as shown in FIG. 4. Instead, the rear edge E of the top 3 (the backmost end P2 on the top 3 side) is visible for the player. such club head 1 allows for the player to easily figure out the contour of the entire club face 2, and facilitates correct and easy addressing.

Figure 1:
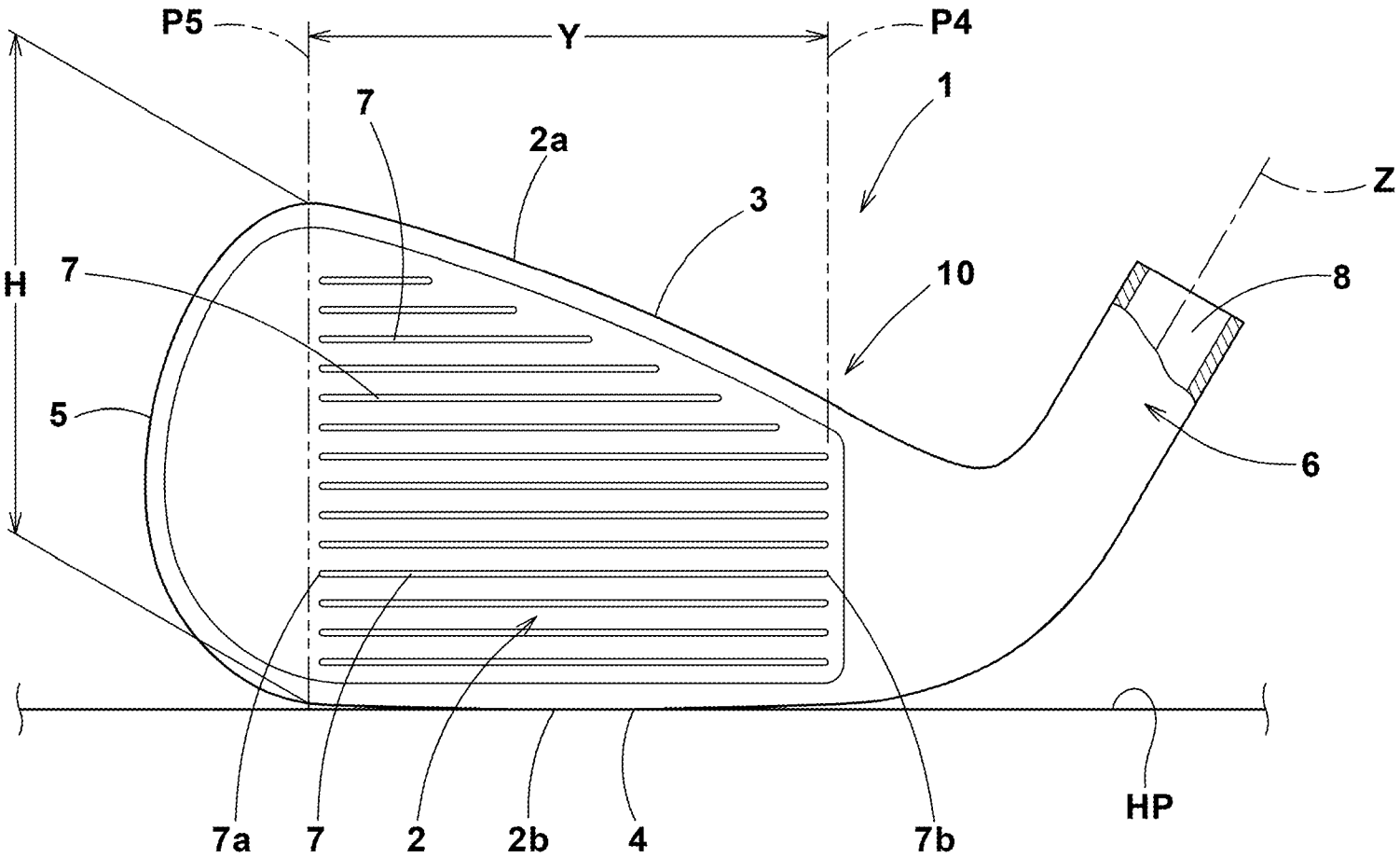
FIG. 1 is a front view of an iron golf club head as an embodiment of the present invention.

As shown in FIG. 1, when a range Y in the toe-heel direction is defined as extending from the position P4 of the heel-side most end 7*b* of the score lines 7 to the position P5 at which the height H of the club face becomes maximum, it is preferable that the horizontal distances A and B satisfy a relationship A≤B at least over the entire range Y.

This is because the player pays particular attention to the range Y when addressing the ball in order to orient the club face 2 toward the target direction.

Preferably, the difference B-A is set to be 3 mm or more, still more preferably 5 mm or more over the entire range Y. Thereby, the position of the backmost end P1 on the sole 4 side, of the club head becomes absolutely out of the player's sight when addressing the ball.

The depth GL of the center of gravity G of the iron golf club head 1 is set to be 5.5 mm or more, while limiting the difference B-A as described above.

As shown in FIG. 6A, the depth GL of the center of gravity G is the shortest distance from the club face 2 to the center of gravity G.

In the conventional iron golf club heads regarded as being easy to address the ball, the depth GL of the center of gravity G is less than 5.5 mm, and the center of gravity G of the club head is positioned nearer to the club face 2. Therefore, the moment of inertia of the club head around the horizontal axis extending in the toe-heel direction passing through the center of gravity G of the club head (hereinafter, referred as the vertical moment of inertia) is small, and there is a tendency that it is difficult to hit the ball high.

In the iron golf club head 1 in this embodiment, contrarily, the depth GL of the center of gravity G is increased to 5.5 mm or more, while maintaining the club head shape easy to address, therefore, the vertical moment of inertia is large. As a result, even if the ball hits a lower part of the club face 2, the club face 2 is hard to tilt downward, in other words, the loft angle at impact is hard to become smaller.

Further, when the depth GL of the center of gravity G is larger, the center of gravity G of the club head tends to position more backward of the axle of the club shaft.

In such golf club, during downswing, the club head is acted by a force to move the center of gravity G of the club head to a position on the axle of the club shaft (not deflected), and the head is rotated such that the club face 2 becomes upward immediately before the impact. As a result, the loft angle at impact is increased, and the ball launching angle is increased. owing to these functions, the iron golf club head 1 whose center of gravity has a large depth GL is advantageous for the average golfers whose golf club head speed is relatively low in that it is easy to shot the ball high.

Preferably, the depth GL of the center of gravity G is 6.0 mm or more.

The present invention can be applied to various iron golf club heads, but suitably applied to iron golf club heads whose loft angle θ is 34 degrees or less.

In such iron golf club heads, as the loft angle θ is small, there is a tendency that it is difficult to shot the ball high. However, by applying the present invention, it becomes possible to shot the ball high and increase the flying distance of the ball, and further easily control the ball ballistic course.

The lower bound of the loft angle θ is not to be limited in particular. But, the loft angle θ may be set to be 22 degrees or more, for example.

The club face 2 of the iron golf club head 1 in this embodiment is formed such that the height H of the club face 2 gradually increases from the heel side toward the toe side as shown in FIG. 1.

The height H of the club face is preferably set in a range from 32.0 to 60.0 mm.

At the above-mentioned position P4 of the heel-side most end 7*b*, the club face has a minimum height H in substance which is for example set in a range from 32.0 to about 40.0 mm.

At the above-mentioned position P5 at which the height H becomes maximum, the height H is for example set in a range from about 52.0 to 60.0 mm. Thereby, the club face 2 is provided with a sufficient area.

The top thickness Tt is preferably set in a range from 3.0 to 10.0 mm. The top thickness Tt is, as shown in FIG. 6B, the thickness of the top 3 measured in a direction perpendicularly to the club face 2.

If the top thickness Tt is less than 3.0 mm, the horizontal distance B becomes small, and there is a possibility that, when addressing the ball, the player gets a view of the sole 4.

If the top thickness Tt is more than 10.0 mm, the position of the center of gravity G of the club head becomes high, and there is a tendency that it becomes difficult to shot the ball high. Thus, it is preferable that the height GH of the center of gravity G (namely, the vertical distance from the horizontal plane HP to the center of gravity G) is set in a range from 16 to 19 mm.

Preferably, the club head thickness Th which is the thickness measured in the direction perpendicularly to the club face 2 from the club face 2 to the rear face of the club head is set in a range from 15.0 to 28.0 mm.

If the club head thickness Th exceeds 28.0 mm, the horizontal distance A becomes large, and there is a possibility that, when addressing the ball, the player gets a view of the sole 4.

If the club head thickness Th is less than 15.0 mm, there is a tendency that the depth GL of the center of gravity G becomes small.

It is preferable that the club head thickness Th at the position P5 is 19.0 to 26.0 mm, and the club head thickness Th at the position P4 is 15.0 to 20.0 mm.

Figure 7:
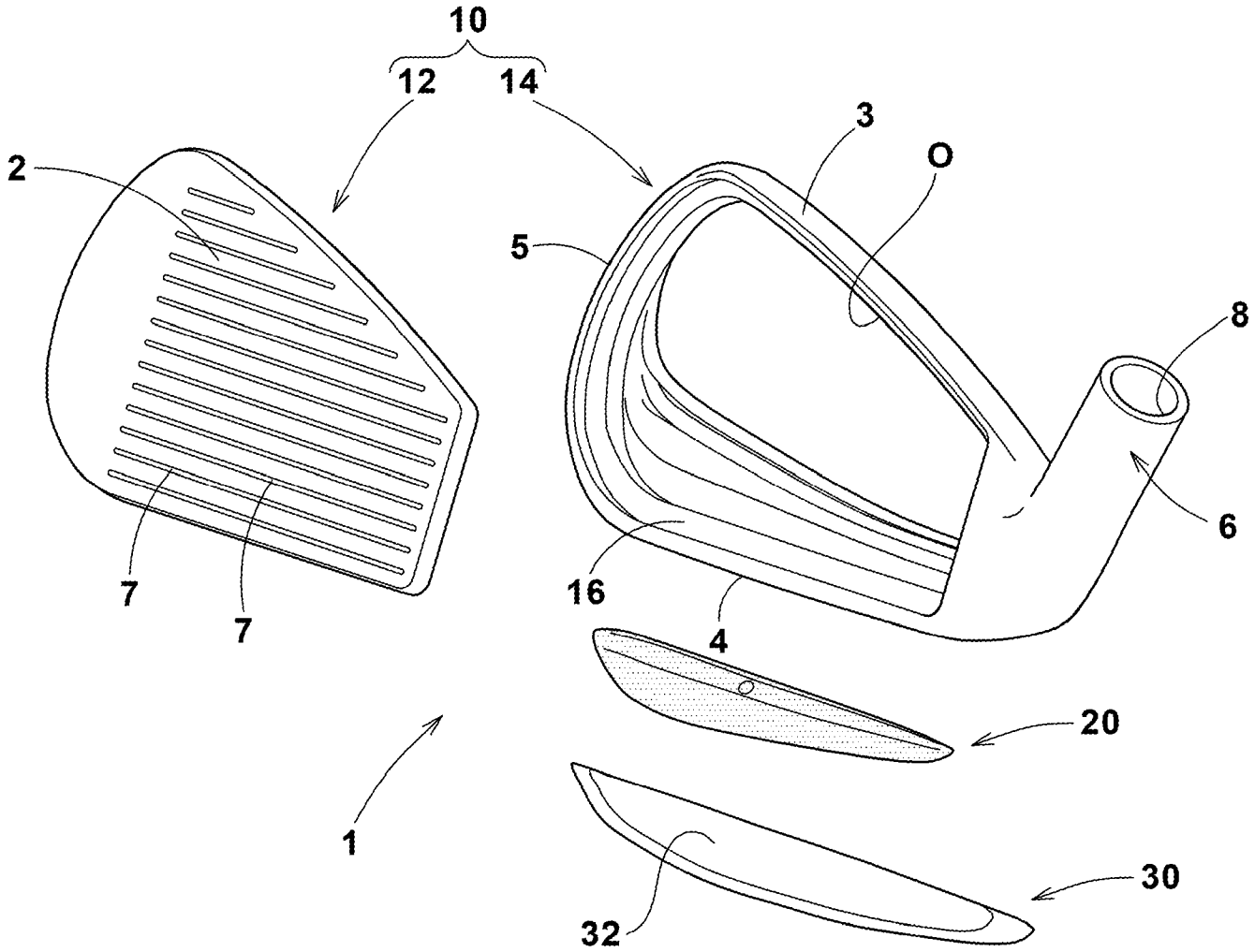
FIG. 7 is an exploded perspective view of the iron golf club head in this embodiment viewed from the front of the club head.
Figure 8:
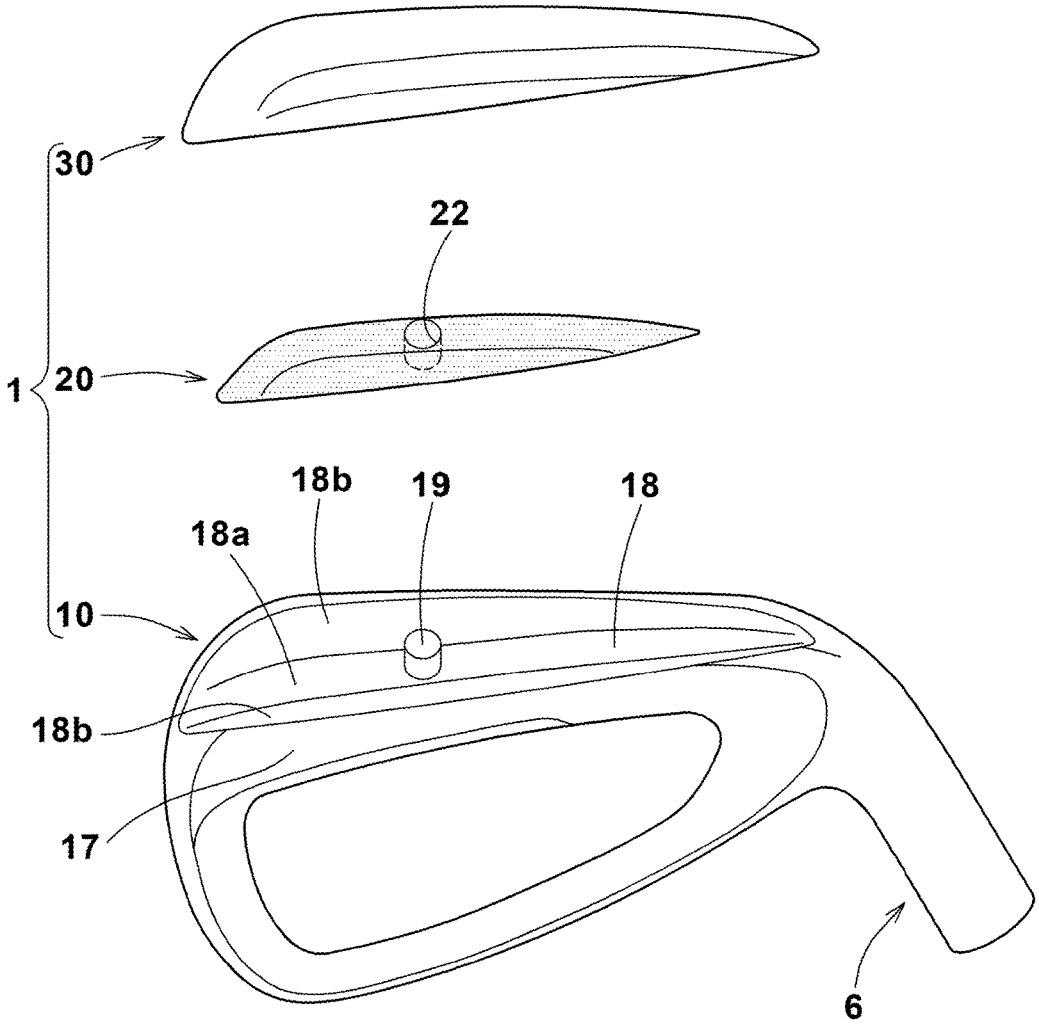
FIG. 8 is an exploded perspective view of the iron golf club head in this embodiment viewed from the rear of the club head.
Figure 9A:
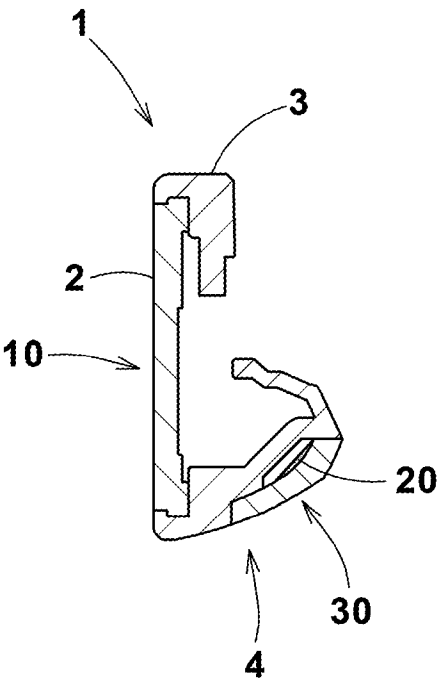
FIG. 9(A) is a cross sectional view taken along line A-A in FIG. 2.
Figure 9B:
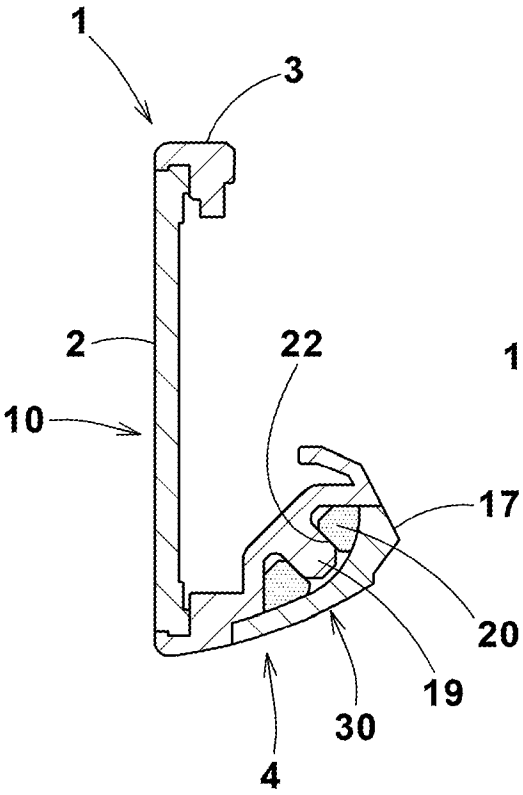
FIG. 9(B) is a cross sectional view taken along line B-B in FIG. 2.
Figure 9C:
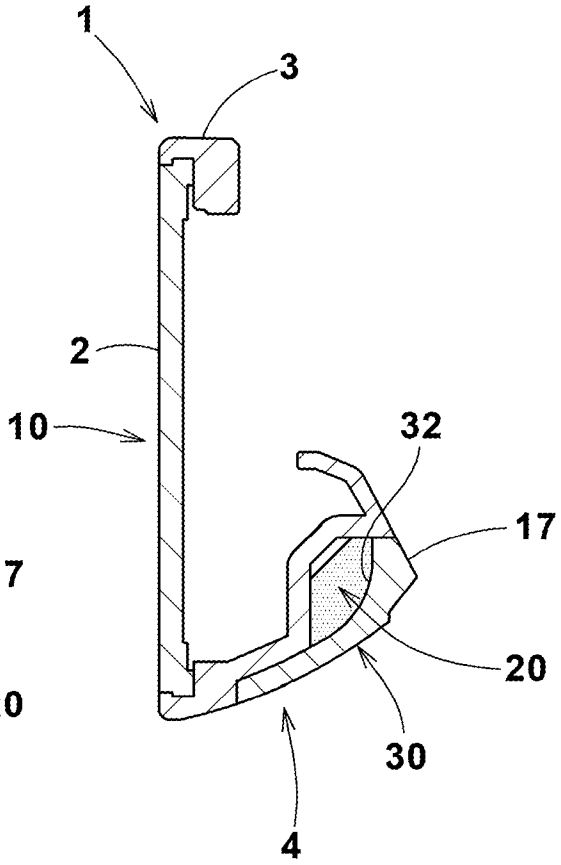
FIG. 9(C) is a cross sectional view taken along line C-C in FIG. 2.

FIG. 7 and FIG. 8 show the disassembled iron golf club head 1. FIGS. 9(A), 9(B) and 9(C) show the cross sections of the iron golf club head 1 taken along line A-A, line B-B and line C-C in FIG. 2, wherein the cross sections are shown in the forward tilting state of the iron golf club head 1.

The forward tilting state is such that the golf club head 1 under the above-mentioned standard state is rotated around a horizontal axis parallel with the toe-heel direction so that the club face 2 becomes perpendicular to the horizontal plane HP.

The iron golf club head 1 may comprise a weight member 20. The iron golf club head 1 may comprise a weight member 20, a head main body 10 and a fixing member 30.

The iron golf club head 1 in this embodiment is composed of a weight member 20, a head main body 10 and a fixing member 30.

The head main body 10 is a component constituting a major part of the iron golf club head 1. The head main body 10 in this embodiment comprises the club face 2 provided with the score lines 7, the top 3, the sole 4, the toe 5 and the hosel 6.

The head main body 10 is, for example, made of a metal material or metal materials.

Preferably, the head main body 10 is composed of a face plate 12 and a face plate receiving part 14 as shown in FIG. 7.

In this embodiment, the face plate 12 is made of a metal material, and the face plate receiving part 14 is made of a metal material different from the face plate 12.

Preferably, the metal material of the face plate 12 has a specific gravity lowest in the metal materials forming the iron golf club head 1 in order to set the position of the center of gravity G more backward of the club head.

For example, the face plate 12 is preferably made of a titanium alloy having a specific gravity of 4.5 or less and a higher specific strength.

The face plate receiving part 14 in this example is provided with a through hole penetrating therethrough in the front-back direction of the club head to have a front opening O, and surround by the top 3, the sole 4 and the toe 5. Further, the face plate receiving part 14 integrally includes the hosel 6.

The face plate receiving part 14 comprises a face plate mounting portion 16, which is formed around the opening O, and to which the peripheral edge portion of the face plate 12 is fixed.

By fixing the face plate 12 to the face plate mounting portion 16, the front opening O is closed by the face plate.

The face plate 12 and the face plate receiving part 14 can be united with each other by using various techniques, for example, welding, brazing, adhesive agent, caulking and the like.

Preferably, the face plate receiving part 14 is made of an iron base alloy having higher strength and good workability such as stainless and carbon steel.

Preferably, the iron base alloy has a specific gravity of not less than 7.0, more preferably not less than 7.5.

Thus, it is possible to locate the center of gravity G more backward of the club head.

As another example, the head main body 10 can be made of a single kind of material or three or more kinds of materials.

In the case of the head main body 10 made of a single kind of material, a typical example is the head main body 10 having one piece structure without the separate face plate 12 and face plate receiving part 14. Another example is the head main body 10 having two piece structure comprising the separate face plate 12 and face plate receiving part 14 both made of an identical material and united with each other.

In the case of the head main body 10 made from three or more kinds of materials, the face plate receiving part 14 is composed of two or more separate parts, and the face plate 12 is fixed thereto.

For example, as shown in FIG. 8, the head main body 10 is provided with a concave portion 18 depressed from a virtual surface corresponding to the outer surface of the club head. In this example, the undermentioned weight member 20 and fixing member 30 are disposed in the concave portion 18, and thereby, the outer surface of the club head is formed. The concave portion 18 is formed in the form of a groove extending long in the toe-heel direction in a sole 4 side of the head main body 10, specifically, in the sole of the face plate receiving part 14.

The weight member 20 is made of a metal material having a specific gravity larger than a specific gravity of the club head main body 10.

Incidentally, the specific gravity of the club head main body 10 is determined from the mass and volume of the club head main body 10 regardless of whether the head main body 10 is composed of one or more components or one or more different materials.

In this embodiment, in order to shift the center of gravity G of the club head downward and backward of the club head, the weight member 20 is disposed in a sole side and rear side of the club head.

Figure 3:
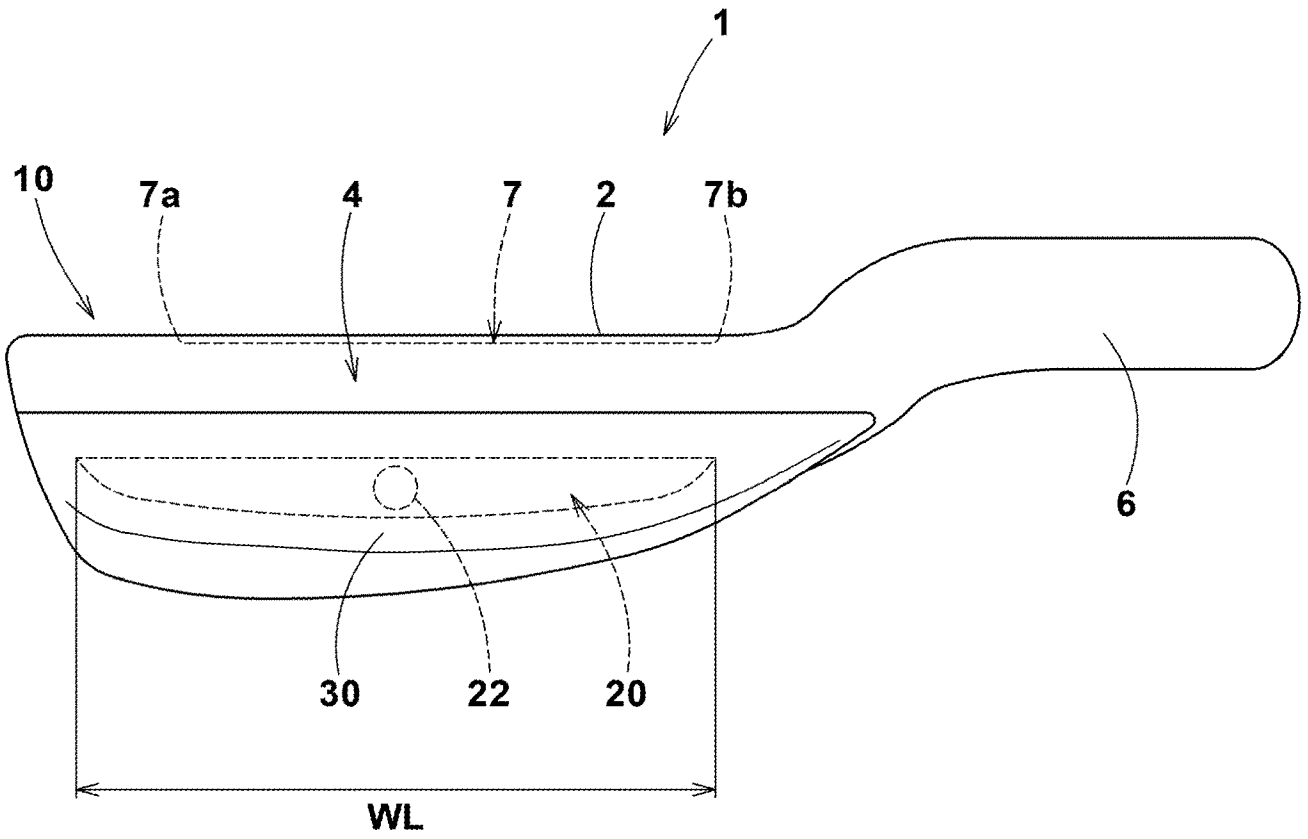
FIG. 3 is a bottom view of the iron golf club head shown in FIG. 1.

As shown in FIG. 7 and FIG. 8, the weight member 20 in this example extends long in the toe-heel direction. specifically, the length WL in the toe-heel direction of the weight member 20 is set to be not less than the distance in the toe-heel direction from the toe-side most end 7*a* to the heel-side most end 7*b* of the score lines 7 as shown in FIG. 3.

The cross-sectional area measured perpendicularly to the toe-heel direction of the weight member 20 is gradually decreased toward both sides in the toe-heel direction.

In view of easiness of adjusting the position of the center of gravity G of the club head and easiness of swinging the golf club, it is preferred that the mass of the weight member 20 is set in a range from about 7% to 12% of the mass of the club head.

The weight member 20 can be made of a tungsten-nickel-iron alloy comprising W, Ni and Fe. The specific gravity of the weight member 20 is not essential, but preferably 10.0 or more, more preferably 12.0 or more, and preferably 18.5 or less. In order to reduce the size of the weight member to improve the production efficiency and increase the flexibility of designing the head, a higher specific gravity is preferred.

The tungsten-nickel-iron alloy achieves a high specific gravity by increasing the tungsten content relatively to the iron content.

When the tungsten content of the alloy is increased, the weldability with the iron base alloy such as soft iron, stainless and carbon steel, namely, the head main body 10 is decreased. This means that it is difficult to strongly fix the weight member 20 to the head main body 10 by using a simple welding technique.

The weight member 20 is disposed within the concave portion 18. Therefore, the volume of the weight member 20 is set to be smaller than the volume of the concave portion 18. The weight member 20 comes into contact with at least part of the surface of the concave portion 18 as explained hereunder.

Figure 2:
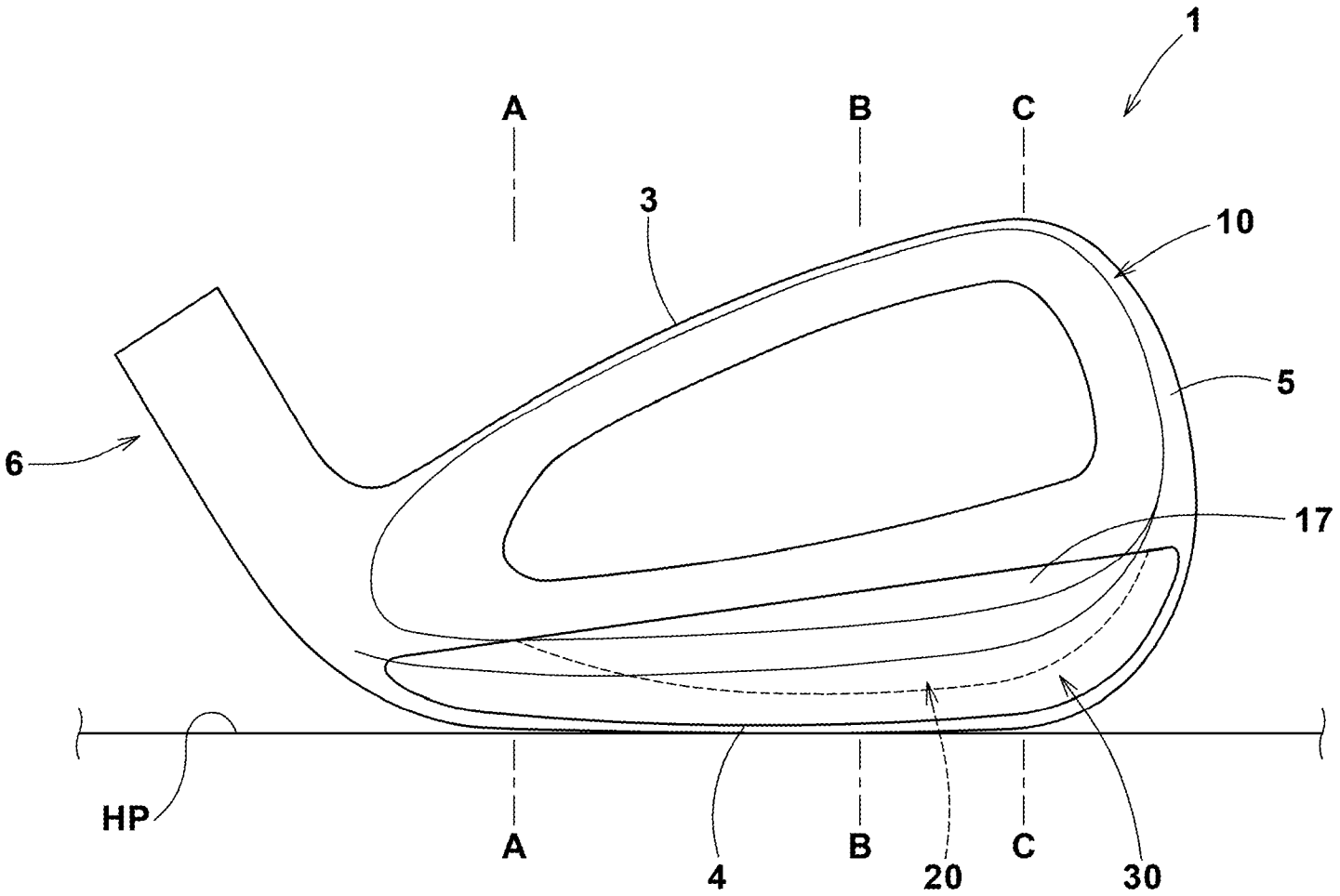
FIG. 2 is a rear view of the iron golf club head shown in FIG. 1.

The fixing member 30 is fixed to the head main body 10 and covers over the weight member 20 as shown in FIG. 2, FIG. 3 and FIG. 9. The fixing member 30 is made of a metal material capable of being fixed to the head main body 10 by welding. Preferably, the specific gravity of the metal material of the fixing member 30 is more than the specific gravity of the club head main body 10, and less than the specific gravity of the weight member 20. The mass of the fixing member 30 can be used to design the position of the center of gravity G of the club head.

Metal materials suitable for the fixing member 30 may include a tungsten-nickel-iron alloy comprising W, Ni and Fe which is decreased in the tungsten content as compared with the tungsten-nickel-iron alloy of the weight member 20, while having a higher specific gravity than the head main body 10 and having a higher weldability (joint strength) with the head main body 10 than the weight member 20. The specific gravity of such fixing member 30 is preferably set in a range from 8.0 to 10.0.

When trying to increase the specific gravity of the weight member 20, usually, it is inevitable that the chemical components of the weight member 20 become largely different from those of the head main body 10. Thus, there is a tendency that the weldability of the weight member 20 with the head main body 10 is decreased. As a result, the degree of freedom of designing the head main body is low, and it is difficult to locate the weight member more backward of the head.

In the example shown in FIG. 2, FIG. 3 and FIG. 9, the fixing member 30 welded to the head main body 10 completely covers over the weight member 20. Thus, even if the weldability of the weight member 20 is poor with respect to the head main body 10, the weight member 20 is fixed to the head main body 10 by the fixing member 30. Accordingly, the design freedom of positing the weight member 20 in the head main body 10 is increased. Thus, even if the horizontal distance A is not more than the horizontal distance B, the depth GL of the center of gravity G can be set to a value of 5.5 mm or more by arranging the high specific gravity weight member 20 backward of the club head.

In order to increase the joint strength, it is preferred that the fixing member 30 is welded to the head main body 10 along the entire length of the peripheral edge of the fixing member 30.

In order to prevent movements and backlash of the weight member 20, it is preferred that the inside surface 32 of the fixing member 30 at least partially contacts with and presses the outside surface of the weight member 20.

The fixing member 30 in this example forms a part of the back face 17. Thereby, owing to the mass of the fixing member 30, the center of gravity G of the club head can be positioned more backward to increase the depth GL of the center of gravity G. The fixing member 30 may form at least part of the sole 4. In this arrangement, owing to the mass of the fixing member 30, the position of the center of gravity G of the club head can be further lowered.

Here, the back face 17 means a surface of the iron golf club head 1 which is visible in the rear view of the iron golf club head 1 under the above-mentioned forward tilting state.

In this example, the fixing member 30 completely covers over the weight member 20.

As another example, the fixing member 30 may cover a part of the weight member 20 as far as the weight member 20 can be secured between the fixing member 30 and the head main body 10.

(Design 1)

Figure 10:
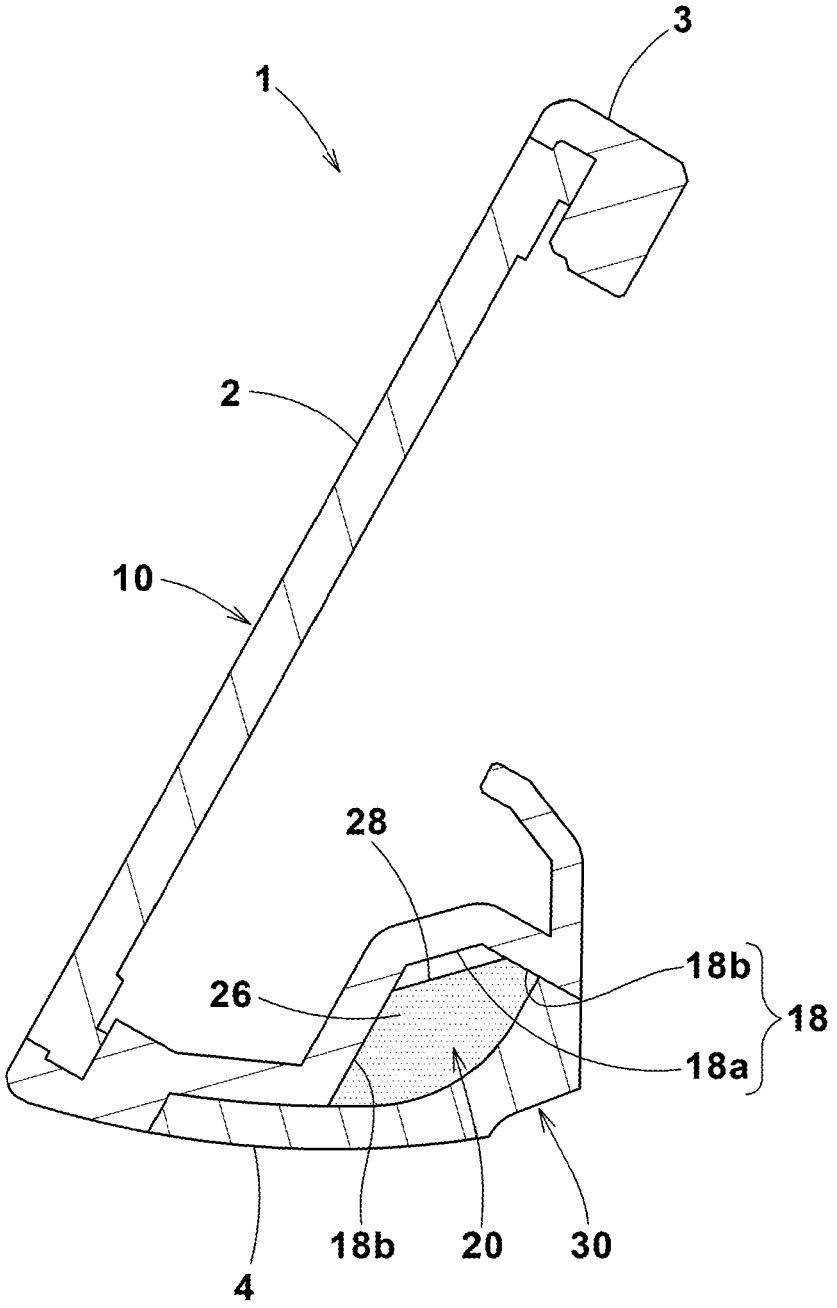
FIG. 10 is a cross sectional view of the iron golf club head taken along line x-x in FIG. 4.

As shown in FIG. 8 and FIG. 10, the concave portion 18 of the club head main body 10 may comprises a bottom face 18*a* denting from the outer surface of the club head, and a pair of slant faces 18*b* arranged in a taper fashion tapering towards the bottom face. Preferably, one of the slant faces 18*b* is parallel with the club face 2, and the other is orthogonal to the club face 2. The bottom face 18*a* is a flat face and intersects with each of the slant faces 18*b* at an obtuse angle, for example, about 135 degrees.

Meanwhile, the weight member 20 is provided with a tapered part 26 fitted between a pair of the slant faces 18*b*, and the surfaces of the tapered part 26 at least partially contact with the respective slant faces 18*b*. However, it is preferable that a truncated face 28 formed at the tip end of the tapered part 26 does not contact with the bottom face 18*a* of the concave portion 18 and a gap is formed. Preferably, the gap is 0.5 mm or more. Thereby, the slant faces 18*b* fix the position of the weight member 20 and prevent movements (in the toe-heel direction, front-back direction and upward direction) of the weight member 20 within the club head, therefore, generation of abnormal noise when hitting the ball due to backlash or vibrations of the weight member 20 within the club head can be prevented.

Incidentally, the tapered part 26 does not require extremely high working accuracy, thereby, the production efficiency may be improved.

(Design 2)

Figure 11:
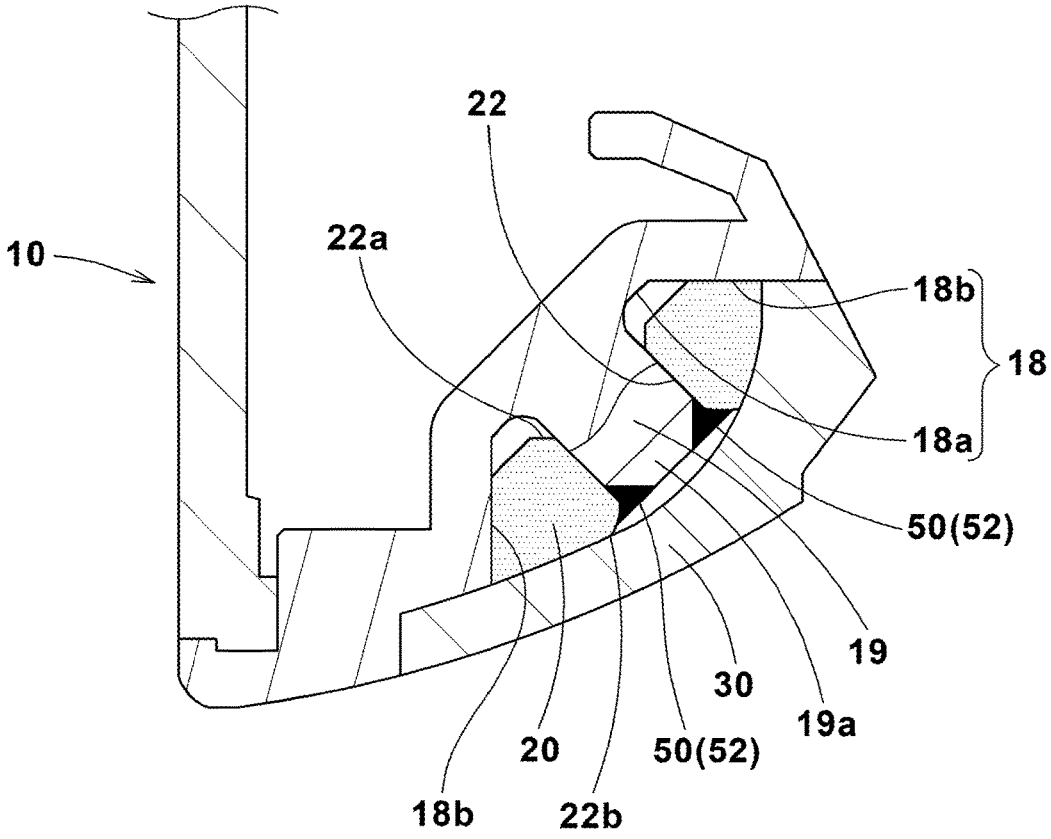
FIG. 11 is a closeup of a part of FIG. 9(B).

As shown in FIG. 9(B) and FIG. 11, the concave portion 18 of the club head main body 10 may be provided with at least one projecting part 19 protruding toward the outside of the club head in addition to or instead of the above Design 1.

The projecting part 19 in this example is formed in the bottom face 18*a* of the concave portion 18. The projecting part 19 in this example is substantially column-shaped. However, the shape of the projecting part 19 is not to be limited thereto.

In this example, only one projecting part 19 is provided. However, two or more projecting parts may be provided in the concave portion 18.

Corresponding to the position of the projecting part 19, the weight member 20 is provided with a through-hole 22 into which the projecting part 19 is fitted. Thereby, backlash and vibrations can be prevented.

Thus, by combining the Design 2 with the above described Design 1, the vibrations and backlash and the resulting abnormal noise can be effectively prevented.

As shown in FIG. 3, the through-hole 22 is preferably disposed in a central portion in the length direction of the weight member 20 in order to effectively prevent backlash and vibrations of the weight member 20.

Here, the length direction of the weight member 20 means a direction in which the maximum length WL of the weight member 20 occurs. In this example, the length direction is the toe-heel direction of the club head.

The central portion of the length direction means a portion ranging 20% of the maximum length WL toward both sides in the length direction from the midpoint of the maximum length WL in the length direction.

(Design 3)

On the basis of the above-described Design 2, a securing part 50 securing the weight member 20 to the head main body 10 may be further provided between the through-hole 22 and the projecting part 19 as shown in FIG. 11.

It is preferable that the securing part 50 fills a possible gap between the through-hole 22 and the projecting part 19 to prevent their relative movements by the friction and/or mechanical engagement between them.

It is not essential, but preferable that the securing part 50 is formed from a metal material 52 welded to the tip end of the projecting part 19 like a weld bead.

For example, such securing part 50 is formed from a metal material 52 melted and penetrated into the gap and then hardened in a state filling the gap and fused with the metal material of the projecting part 19, namely, that of the club head main body 10 in this example. Therefore, even if the securing part 50 is not fused with or welded to the weight member 20, as the space between the through-hole 22 and the projecting part 19 decreases or disappears, the adhesion between the securing part 50 and the weight member 20 is improved. This effectively prevent vibrations of the weight member 20 relative to the head main body 10, namely, vibrations in perpendicular directions to the protruding direction of the projecting part 19.

In order that the securing part 50 can firmly and stably fix the weight member 20 by increasing its bonding strength to the projecting part 19, the tip end of the projecting part 19 in this example is provided with a tapered portion 19*a* so that an annular space (gap) increasing towards the outer surface of the club head is formed between the tapered portion 19*a* and the through-hole 22.

The melted metal material 52 filling the annular space is increased in the volume and the contact surface with the projecting part 19, therefore, the bonding strength and the strength itself are increased.

In this example, the metal material 52 is given as a separate material from the projecting part 19 and the weight member 20 and fused with the projecting part 19.

But, it may be also possible to use a portion of the projecting part 19 melted as the melted metal material 52.

In any case, the metal material 52 hardened around the projecting part 19 forms the securing part 50 capable of firmly and stably fixing the weight member 20.

The through-hole 22 of the weight member 20 has an inside opening 22*a* toward the inside of the club head and an outside opening 22*b* toward the outside of the club head, and the outside opening 22*b* preferably has a larger opening area than the inside opening 22*a*. More specifically, the through-hole 22 in this example comprises a tapered portion in which the area of the cross section of the through-hole 22 perpendicular to its protruding direction is gradually decreased from the outside opening 22*b* toward the inside opening 22*a*. This also gradually increases the space between the through-hole 22 and the projecting part 19 for forming the securing part 50, toward the outside of the club head. Such space helps the melted metal material 52 poured therein to penetrate deep into the space, for example, near to the root of the projecting part 19. Thus, the securing of the weight member 20 from the outer side of the club head by the metal material 52 is enhanced. As a result, movements of the weight member 20 in the protruding direction of the projecting part 19 can be mechanically effectively prevented even if the weight member 20 is not welded, and abnormal noise due to such movements can be completely prevented.

Figure 12:
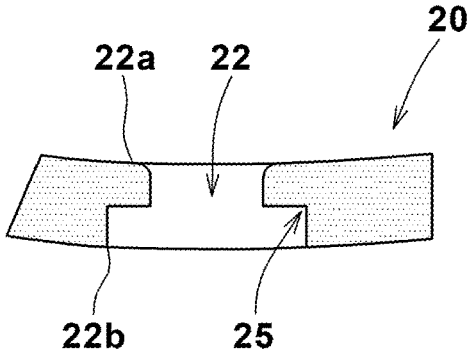
FIG. 12 is a cross sectional view of a modified example of the weight member taken at a position corresponding to line B-B in FIG. 2.

FIG. 12 shows another example of the through-hole 22 whose outside opening 22*b* is increased in the opening area. In this example, the through-hole 22 comprises an enlarged portion 25 on the outside opening 22*b* side in which the area of the cross section of the through-hole 22 is increased stepwise from its immediately inside portion.

It is preferable to employ the enlarged portion 25 in combination with the projecting part 19 with the tapered portion 19*a*. But, it is also possible to employ the enlarged portion 25 in combination with the projecting part 19 without the tapered portion 19*a*.

Aside from the above-described metal material 52, a wedge member press-fitted into the space between the projecting part 19 and the through-hole 22 such as a ring-shaped elastic body, a ring of an elastomer and a ring of a metal may be used as the securing part 50.

In either case, the securing part 50 is invisibly covered over with the fixing member 30, therefore the securing part 50 does not negatively affect the exterior appearance of the club head.

While detailed description has been made of a preferable embodiment and modifications of the present invention, the present invention can be embodied in various forms without being limited to the illustrated embodiment.

Comparison Tests

Based on the structure described with reference to FIGS. 1 to 6, iron golf club heads having specifications shown in Table 1 were experimentally manufactured, and attached to identical shafts to make iron golf clubs.

Using the iron golf clubs, the club heads were tested for the easiness to address the ball and the loft angle during swing immediately before the impact.

In Table 1, the club face height, the top thickness, the club head thickness and the difference B-A in the horizontal distance were measured at a position of 27 mm toward the toe from the heel-side most end of the score lines (namely, substantially center position of the above-mentioned range Y).

The easiness to address the ball was sensory evaluated by ten golfers whose average head speed is 32 m/s into five ranks, wherein the larger value means that it is easer to orient the club face toward the target direction, namely, easer to address the ball. In Table 1, the average of the evaluations by the ten golfers is shown.

The loft angle immediately before the impact was measured using a portable ballistic tracker. The results are shown in Table 1, wherein the larger angle means that it is easier to shot the ball high.

TABLE 1

| Club head | Embodiment 1 | Ref. 1 | Ref. 2 | Ref. 3 | Ref. 4 | Ref. 5 |
|---|---|---|---|---|---|---|
| club face height H (mm) | 45 | 46 | 31 | 40 | 35 | 45 |
| top thickness Tt (mm) | 7.5 | 7.5 | 6.2 | 8.2 | 6 | 12 |
| club head thickness Th (mm) | 19 | 18 | 23 | 25 | 30 | 16 |
| score line length (mm) | 55 | 55 | 57 | 55 | 55 | 55 |
| loft angle θ (deg.) | 26 | 26 | 26 | 26 | 26 | 26 |
| difference B-A (mm) | 6.1 | 7.5 | −4.8 | −0.9 | −9.5 | 12.9 |
| depth GL of gravity center (mm) | 6.0 | 4.0 | 7.0 | 5.2 | 8.0 | 3.5 |
| backmost end P1 | invisible | invisible | visible | visible | visible | invisible |
| easiness to address | 4.5 | 4.5 | 2 | 2.3 | 2 | 3.5 |
| loft angle immediately before impact (deg) | 23 | 22.1 | 24 | 23.5 | 24.5 | 21.7 |

From the test results, it was confirmed that the iron golf club heads according to the present invention were increased in the depth of the center of gravity while allowing the players to easily address the ball.

REFERENCE SIGNS LIST

1 iron golf club head
2 club face
3 top
4 sole
6 hosel
7 score line
10 head main body
20 weight member
30 fixing member
A, B horizontal distance
G center of gravity
GL depth of G

The invention claimed is:

1. An iron golf club head comprising:
a club face provided with score lines,
a top extending backward of the club head from an upper edge of the club face,
a sole extending backward of the club head from a lower edge of the club face, and
a hosel disposed in a heel side of the club head and provided with a shaft inserting hole,
wherein
the depth of the center of gravity of the club head is 5.5 mm or more,
wherein
in a standard state of the club head in which the club head is set on a horizontal plane such that the score lines become horizontal and the central axis of the club shaft inserting hole lies within a vertical plane,
the club head satisfies the following condition (1) in the cross section of the club head taken orthogonally to the above-said vertical plane at any position within a range in the toe-heel direction of the club head which range is defined between the position of the heel-side most end of the score lines and the position at which the height of the club face becomes maximum:
(1) the horizontal distance A from the lower edge of the club face to the position of a backmost end of the club head on the sole-side is not more than the horizontal distance B from the lower edge of the club face to the position of a backmost end of the club head on the top-side, and
wherein
the club face height is in a range from 32.0 to 60.0 mm.

2. The iron golf club head according to claim 1, wherein the loft angle of the club face is 34 degrees or less.

3. The iron golf club head according to claim 1, wherein the top thickness which is the thickness of the top measured in a perpendicular direction to the club face is in a range from 3.0 to 10.0 mm.

4. The iron golf club head according to claim 1, wherein the club head thickness which is the thickness from the club face to the rear face of the club head measured in a perpendicular direction to the club face is in a range from 15.0 to 28.0 mm.

5. An iron golf club head comprising:
a club face provided with score lines,
a top extending backward of the club head from an upper edge of the club face,
a sole extending backward of the club head from a lower edge of the club face, and
a hosel disposed in a heel side of the club head and provided with a shaft inserting hole,
wherein
the depth of the center of gravity of the club head is 5.5 mm or more,
wherein
in a standard state of the club head in which the club head is set on a horizontal plane such that the score lines become horizontal and the central axis of the club shaft inserting hole lies within a vertical plane,
the club head satisfies the following condition (1) in the cross section of the club head taken orthogonally to the above-said vertical plane at any position within a range in the toe-heel direction of the club head which range is defined between the position of the heel-side most end of the score lines and the position at which the height of the club face becomes maximum:

(1) the horizontal distance A from the lower edge of the club face to the position of a backmost end of the club head on the sole-side is not more than the horizontal distance B from the lower edge of the club face to the position of a backmost end of the club head on the top-side, wherein the loft angle of the club face is 34 degrees or less, and wherein the top thickness which is the thickness of the top measured in a perpendicular direction to the club face is in a range from 3.0 to 10.0 mm.

6. The iron golf club head according to claim 5, wherein the club face height is in a range from 32.0 to 60.0 mm.

7. The iron golf club head according to claim 5, wherein the club head thickness which is the thickness from the club face to the rear face of the club head measured in a perpendicular direction to the club face is in a range from 15.0 to 28.0 mm.

8. An iron golf club head comprising:

a club face provided with score lines, a top extending backward of the club head from an upper edge of the club face, a sole extending backward of the club head from a lower edge of the club face, and a hosel disposed in a heel side of the club head and provided with a shaft inserting hole, wherein the depth of the center of gravity of the club head is 5.5 mm or more, wherein in a standard state of the club head in which the club head is set on a horizontal plane such that the score lines become horizontal and the central axis of the club shaft inserting hole lies within a vertical plane, the club head satisfies the following condition (1) in the cross section of the club head taken orthogonally to the above-said vertical plane at any position within a range in the toe-heel direction of the club head which range is defined between the position of the heel-side most end of the score lines and the position at which the height of the club face becomes maximum:

(1) the horizontal distance A from the lower edge of the club face to the position of a backmost end of the club head on the sole-side is not more than the horizontal distance B from the lower edge of the club face to the position of a backmost end of the club head on the top-side, and wherein the iron golf club head is composed of:

a head main body having the club face, a weight member having a specific gravity larger than that of the club head main body, and a fixing member fixed to the head main body and covering the weight member.

9. The iron golf club head according to claim 8, wherein the top thickness which is the thickness of the top measured in a perpendicular direction to the club face is in a range from 3.0 to 10.0 mm.

10. The iron golf club head according to claim 9, wherein the club head thickness which is the thickness from the club face to the rear face of the club head measured in a perpendicular direction to the club face is in a range from 15.0 to 28.0 mm.

11. The iron golf club head according to claim 8, wherein the weight member is made of a material having lower weldability with a material of the club head main body, the specific gravity of the fixing member is more than the specific gravity of the club head main body, and less than the specific gravity of the weight member, the fixing member is made of a material having higher weldability with the material of the club head main body, and the fixing member is fixed to the head main body by welding.

12. The iron golf club head according to claim 8, wherein at least part of the club face is formed by a titanium alloy.

* * * * *